United States Patent [19]

Graham et al.

[11] Patent Number: 4,678,012

[45] Date of Patent: Jul. 7, 1987

[54] CLEANING AND YARN CONDITIONING SYSTEM FOR WEAVING MACHINES

[76] Inventors: Walker O. Graham, 105 Sycamore Dr., Mauldin, S.C. 29662; William T. Pearson, Lakewood Dr., Prosperity, S.C. 29127

[21] Appl. No.: 892,936

[22] Filed: Aug. 4, 1986 (Under 37 CFR 1.47)

[51] Int. Cl.[4] ..... D03J 1/02

[52] U.S. Cl. ..... 139/1 C

[58] Field of Search ..... 139/1 R, 1 C; 15/306 A; 57/304

[56] References Cited

U.S. PATENT DOCUMENTS 3,491,801 1/1970 Lippuner ..... 139/1 C

FOREIGN PATENT DOCUMENTS 517248 8/1928 Fed. Rep. of Germany ..... 139/1 C

*Primary Examiner*—Henry S. Jaudon

*Attorney, Agent, or Firm*—Dority & Manning

[57] ABSTRACT

In a weaving machine having a warp supply, a harness motion, a reed and filling insertion mechanism, vacuum chambers are provided adjacent to the weft insertion station for drawing air from the ambient atmosphere of the weave room across the weft yarn to concentrate the ambient air from the atmosphere onto such yarn and to condition the same, and also to move the air drawn from the ambient atmosphere across the adjacent surfaces of the weaving machine for removing fly, lint, dust, oil or the like from such surfaces, and for preventing such material from becoming incorporated into the fabric.

16 Claims, 5 Drawing Figures

CLEANING AND YARN CONDITIONING SYSTEM FOR WEAVING MACHINES

This invention relates to improvements in a system for cleaning weaving machines, and at the same time, conditioning both the weft and warp yarns to improve both the quality of the fabric and the production of the weaving machines. The invention relates to equipment which is strategically located in those areas of the weaving machine where a significant part of lint, fly, dust, oil, etc. are generated from the warp and weft yarns. Drawing air from the ambient atmosphere in the weave room across the warp yarns just before they are subjected to the violent stresses of forming the warp shed and beating-up the weft makes it possible to reduce the overall humidity in the ambient atmosphere of the weave room and still provide adequate humidity for the conditioning of the warp and weft yarns just prior to their weaving.

Lint, fly and dust (hereinafter referred to as lint) are minute textile fibers, size and other particles which have become separated from the warp locations, especially where the warp yarns pass through the eyes of the drop wire, the eyes of the heddles, and between the blades of the reed. Lint is also generated from handling of the weft yarn. Such lint tends to collect on the surfaces of the weaving machine and is often incorporated into the fabric inadvertently when a large chunk of such lint falls off the surface of the weaving machine into the warp shed, or is entwined about individual warp yarns and passes into the fabric past the beat-up point, resulting in defective fabric.

Lint is also objectionable because thick layers of the lint forming on the weaving machine surfaces may clog the weaving machine by falling into the weaving machine mechanisms. Furthermore, such large accumulations of this highly flammable material constitutes a fire hazard.

The general cleaning approach in most mills today is to permit the lint to accumulate on the surfaces of the weaving machine and periodically to manually blow such lint off of the weaving machine surfaces onto the floor where it is manually swept up by brooms. This removes a large amount of the lint, however, much of the lint is suspended in the air and lands back on the weaving machines, accumulates on the walls or ceilings, or into the fabric. With the high speed weaving machines used in today's textile plants, much production is lost due to the cleaning of the machines, therefore, it has become necessary to provide means for cleaning the weaving machines continuously to remove the bulk of the lint from the surfaces of the weaving machine.

Many attempts have been made to provide for a cleaning mechanism on weaving machines. One such attempt is shown in U.S. Pat. No. 3,627,201. This patent teaches a system which requires that each weaving machine be provided with a downwardly opening hood which fits snugly around the weaving machine and which has an annular rim around the downwardly directed opening thereof. The hood is supported by a mechanism which moves the hood upwardly and away from the operative position. The atmosphere within the hood is said to be maintained at a temperature of 15° to 50° C. by a source of air at that temperature which is supplied through the floor under the weaving machine. An exhaust conduit is also provided for leading the air injected into the hood outwardly after it has circulated around the weaving machine.

There are many problems connected with the device in U.S. Pat. No. 3,627,201. The main problem is that the mechanism is very cumbersome and it is very difficult for the weavers to have access to the weaving machines when broken warp yarns or the like must be repaired. Furthermore, the system disclosed in this patent does little or no cleaning of the surfaces of the weaving machine.

Another attempt was made in U.S. Pat. No. 3,378,998. In this patent, an attempt is made to provide an enclosure for the yarn manipulating mechanism of a weaving machine. A hood is provided for enclosing the upper portion of the weaving machine. This hood has an opening for receiving air. An air input means is connected to the opening in the hood. A central chamber is attached to the hood which encloses the working instrumentalities of the weaving machine at points where the lint is normally discharged and collects. A base enclosure is connected to the central chamber for receiving accumulated lint from the central chamber. A suction and collecting unit is provided for the base enclosure for creating a negative pressure within the hood. The flow of air through the enclosure is said to pass through the machinery and to maintain it substantially free from lint and fly.

The enclosure of U.S. Pat. No. 3,378,998 makes it very difficult for the weaver to get at the weaving mechanism to repair broken warp ends or broken weft ends, as was pointed out above, with regard to the device in U.S. Pat. No. 3,627,201. It should also be pointed out, however, that the air flow both of these patents is generalized and is not concentrated upon the surfaces wherein the lint is most likely to accumulate. The general flow of air through these all encompassing housings does not remove the lint from the machine surfaces unless the flow is so strong as to cause false stops of the warp motion. While the device in U.S. Pat. No. 3,378,998 might be adequate for conditioning the yarn, it is not adequate for cleaning the surfaces of the weaving machine, and is so burdensome upon the weavers as to preclude its commercial usage.

An early attempt to clean a weaving machine was suggested in U.S. Pat. No. 1,850,502. In this patent, a pan-like device is located below the warp threads between the harnesses and the whip roll for collecting dust, fly and lint by a downdraft of air induced by a suction device, which is connected to the bottom of the pan or receptacle. While this device may collect some fly or lint from the warp yarns there is no suggestion that this device could clean adjacent surfaces of the weaving machine or condition the warp yarn by drawing the ambient atmosphere over and through the warp yarns.

A more recent attempt, which is similar to that of U.S. Pat. No. 1,850,502 is found in U.S. Pat. No. 2,984,263. In the system shown in this patent, a collection system is mounted directly on the weaving machine under the stop motion where it is said that the major fly and lint accumulation takes place. The system of this patent primarily utilizes a directed high velocity stream of air to cause a low pressure area in its surrounding environment, which draws the lint and fly to it and then transmits the lint and fly to a desired collection point. The use of such an air stream is said to be much more efficient than the use of a vacuum, and thus enables the device to collect large portions of lint and fly without the use of large, powerful or expensive equipment. While the device shown in this patent may be an efficient collector of lint which falls onto the surfaces of its baffles, there is nothing in this patent to indicate that the ambient atmosphere of the weave room is drawn across the surfaces of the warp yarn to condition such yarn prior to weaving. Furthermore, no provision is made for cleaning the surfaces of the heddles or harnesses or weft insertion device where large amounts of fly and lint are also generated.

In U.S. Pat. No. 3,451,435, a nozzle body with the shape of a prism is positioned across the warp directly above the reed and adjacent to the heddles of the weaving machine so that air currents containing dust are fanned by the oscillating reed into the inlet of a suction nozzle. While this device may be adequate to remove lightweight dust, fly or lint set into motion already by the reed, it is not adequate for conditioning the warp yarn or the weft yarn, nor does this mechanism suggest or teach any way in which the stop motion can be cleaned and the warp yarn conditioned at the same time.

Another more elaborate attempt to provide a cleaning mechanism for a weaving machine is found in U.S. Pat. No. 3,311,135. In this system, the patentees suggest the provision of one enclosure for the sley and reed and another enclosure for the warp stop motion, and still a third enclosure for the harness mechanism. The patentees suggest that the air within the various enclosures is conditioned and that such housings or enclosures, prevent the escape of lint or fly into the weave room at large. While the enclosures shown and suggested in this patent will enable the maintenance of the desired atmospheric conditions within the chambers and will provide some cleaning of adjacent weaving machine surfaces, it still suffers from the adverse drawback of being very difficult for the weaver to operate the weaving machines with this mechanism in place.

Still another attempt to provide a cleaning mechanism is found in U.S. Pat. No. 3,678,965. In this patent, lint and fly is said to be effectively and efficiently removed by suction box 34 located in the path of the warp yarns between the warp stop motion and the harnesses, with a first suction opening directed towards the warp stop motion, and a second suction opening directed towards the harnesses. Suction means is connected to the suction box for drawing the atmosphere across the warp stop motion and across the harnesses. However, this device is in a position which will necessarily interfere with the weaving operations by the weavers. For example, one merely has to observe FIG. 1 to determine how difficult it would be for the weaver to repair broken warp yarns which requires him to thread-up a new yarn through the stop motion, the hood and the warp heddles. Thus, such handicaps to the weaver makes it very unlikely that this device can function successfully on a commercial basis.

SUMMARY OF THE INVENTION

It is a primary object of this invention to provide an improved system for removing lint, size, oil, fly or other contaminating substances from selected surfaces of the weaving machine, while at the same time drawing air from the ambient atmosphere across both the warp and the weft to condition the warp and the weft.

It is another more specific object of the invention to provide a vacuum chamber located beneath and partially surrounding the warp stop motion, in a position where air from the ambient atmosphere is drawn across the warp yarns to condition the same at the warp stop motion, and where such air is also drawn across the surfaces of the drop wires and the supporting bars for the drop wires so that any lint, fly, dust or oil accumulations will be drawn into the vacuum chamber.

It is another object of the invention to provide a vacuum chamber located beneath and partially surrounding the harnesses for drawing air from the ambient atmosphere across the warp at the point where the greatest stress is applied to the warp to condition the warp and to remove therefrom and from the adjacent harness surfaces any accumulations of lint, fly, oil or other size which may interfere with the production of high quality cloth.

Still another object of the invention is to provide means for drawing air from the ambient atmosphere across the picking position and the weft yarn to condition the weft yarn and to provide an air flow across the adjacent weaving machine surfaces.

It is a still further object of the invention to provide means for conditioning the warp and the weft yarn simultaneously and for cleaning the surfaces of the weaving machine at the stop motion at the harnesses, and at the weft loading and picking station of the weaving machine.

These and other objects and advantages of the invention will appear from a description taken hereinafter in connection with the accompanying drawings, illustrating a preferred embodiment of the form of the invention to accomplish these objectives.

The invention provides a first vacuum chamber for conditioning the warp yarn at the stop motion and for cleaning the adjacent surfaces of the weaving machine thereat, a second vacuum chamber adjacent to the harnesses for again conditioning the warp yarn at the point it receives its greatest stress and for cleaning the adjacent surfaces of the weaving machine, that is the surfaces of the heddles, the harness frames and the frame members of the weaving machine which supports the harness motion; and a third vacuum chamber which extends ajdacent to the weft insertion mechanism so as to draw air from the ambient atmosphere across the weft yarn and for drawing air across the weft yarn handling mechanism for cleaning or removing lint, fly, starch, oil, or other materials from the surface of the weft picking mechanism.

BRIEF DESCRIPTION OF THE DRAWINGS

The invention will be better understood when considering the following detailed description in conjunction with the accompanying drawings wherein.

DETAILED DESCRIPTION OF THE INVENTION

Figure 1:
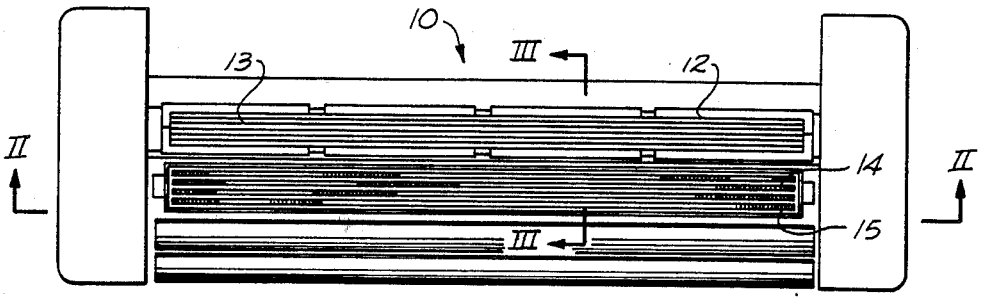
FIG. 1 is a top plan view of a portion of a weaving machine showing the harnesses and warp stop motion.
Figure 2:
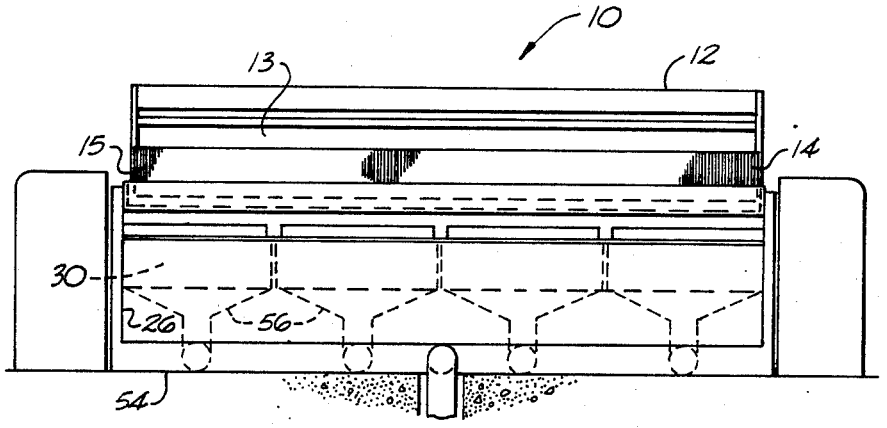
FIG. 2 is a rear view of the weaving machine taken generally along lines 2—2 of FIG. 1 with some parts shown in phantom for sake of clarity.
Figure 3:
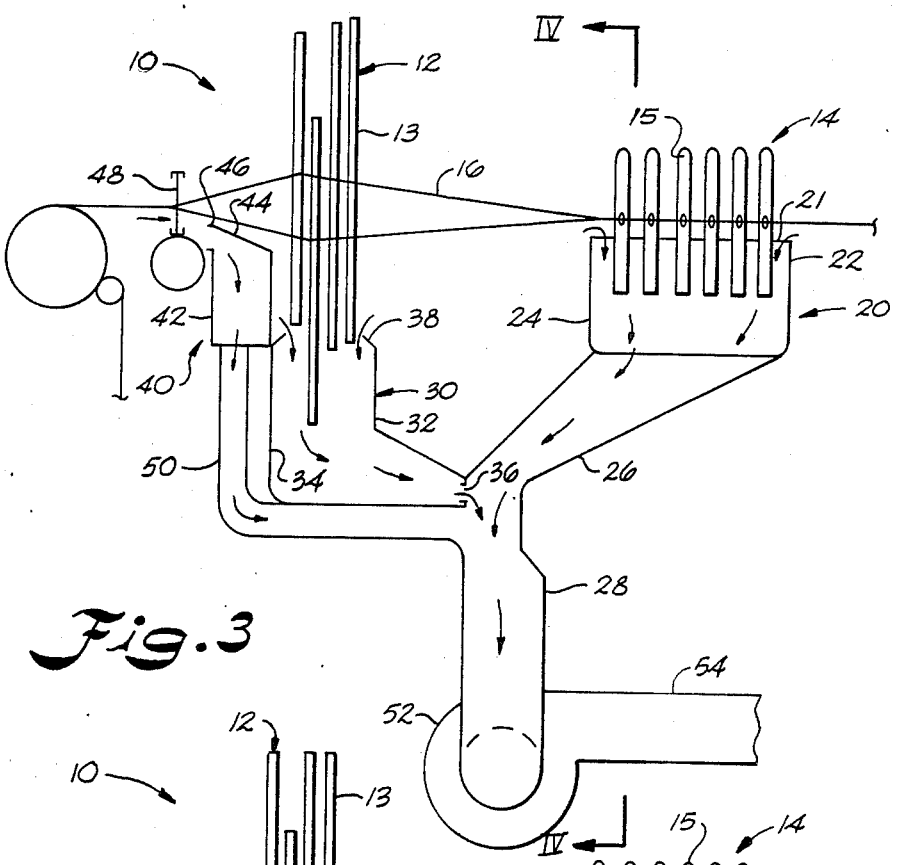
FIG. 3 is a side elevational diagrammatic view of a weaving machine taken generally along lines 3—3 of FIG. 1, but showing weaving machine elements not illustrated in FIG. 1.

Referring now to FIGS. 1, 2, and 3 of the drawings, a weaving machine 10 is provided with harnesses 12 having heddles 13 and a stop motion 14 with a series of drop wires 15. Warp yarns 16 are drawn through eyes in the drop wires 15 and through eyes in heddles 13, and thence through a reed 48 for incorporation into a fabric by the insertion of weft yarn (not shown). A partially closed vacuum chamber 20 is located beneath warp stop motion 14 and comprises side walls 22 and 24 and ends 23 and 25. A clearance 21 is provided between the warp stop motion and the walls and the ends of the vacuum chamber to prevent the vacuum chamber from interfering with the operation of the warp stop motion.

An exhaust duct 26 connects vacuum chamber 20 to a central exhaust duct 28 which is connected to a blower or turbine 52 for creating a partial vacuum within vacuum chamber 20.

When a partial vacuum is created within vacuum chamber 20, the ambient atmosphere of the weave room is drawn into the vacuum chamber longitudinally of the drop wires and through the sheet of warp yarn 16 to remove lint, fly, dust, oil or the like from the surfaces of the drop wires and to condition the warp yarn by concentrating the humidified ambient atmosphere onto the warp yarns just prior to their being subjected to their greatest stress during the warp shed formation.

Disposed beneath the harnesses 12 is a vacuum chamber 30 having walls 32 and 34 and ends (not shown) which partially enclose the harnesses. Vacuum chamber 30 has an exhaust opening 36 which connects it to exhaust duct 26 and therethrough to central exhaust duct 28 and turbine 52. A clearance 38 is provided between the harnesses and walls 32 and 34 to permit the harnesses to function during the weaving operation without interference from the vacuum chamber walls.

Adjacent to the reed 48 is vacuum chamber 40 which comprises walls 42 and 44 which terminate into an elongated nozzle 46 which is stationarily mounted adjacent to the reed when the reed and its supporting sley is in the back center position. In this position, vacuum chamber 40 draws air from the ambient atmosphere of the weave room across the reed and sley, and across the weft yarn as the weft is being inserted into the warp shed. Of course, the ambient atmosphere is also drawn through the warp yarns 16 just prior to the beat-up of the weft yarn. This results a further conditioning of the warp yarn and the conditioning of the weft yarn just prior to the beat-up of the weft into the fabric. An exhaust duct 50 is connected to vacuum chamber 40 and also to central exhaust duct 28 and turbine 52 for the creation of a partial vacuum within vacuum chamber 40 whenever turbine 52 is operating.

As seen in FIGS. 1, 2, and 3, the operation of turbine or blower 52 creates a partial vacuum in vacuum chambers 20, 30 and 40. The partial vacuum in vacuum chamber 20 causes air from the ambient atmosphere to be drawn across the surfaces of the drop wires and their supporting mechanism and through the warp yarn passing therethrough to condition the warp yarn and to clean the adjacent surfaces of the weaving machine, such as the stop motion drop wires and the like.

When a partial vacuum is created in vacuum chamber 30, air from the ambient atmosphere is drawn longitudinally of the harnesses 12 and through the warp yarns 16 at the point such warp yarns are subjected to the greatest stress, that is during the formation of the warp shed.

The creation of a partial vacuum in vacuum chamber 40 draws air from the ambient atmosphere across the reed and sley and across inserted weft yarn so as to condition the weft yarn just prior to its being beaten up into the fell of the fabric, and to remove any lint, fly, dust, oil or the like which may be present on the reed blades or on the race plates of the sley.

Thus, it is seen that the creation of a partial vacuum within the three vacuum chambers results in the concentration of the ambient atmosphere on the warp yarn at three different locations, namely, at the location of the warp stop motion, the harnesses and the reed and concentrated air currents are drawn across the adjacent surfaces of the weaving machine for cleaning the same and for removing any lint, fly, dust, oil or the like therefrom.

Referring now particularly to FIG. 2, it will be noted that vacuum chamber 30 is shown in phantom and is shown to be four distinct segments. Where the weaving machine is very wide, it will be necessary to segmentize the vacuum chambers in order to achieve uniform conditioning of the yarn and cleaning of the surfaces. In many instances in very wide weaving machines, it will be necessary to segmentize the vacuum chamber 20 and vacuum chamber 40, as well, to the extent that available space permits.

Figure 5:
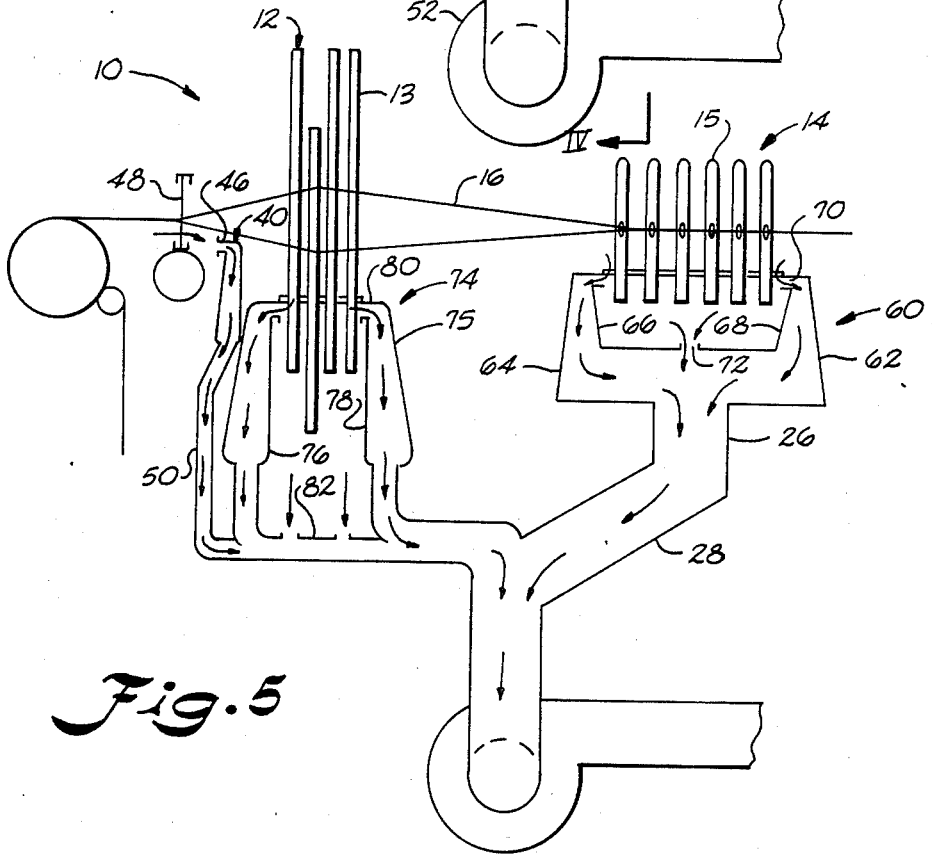
FIG. 5 is a view similar to that of FIG. 3 but showing another embodiment of the invention.
Figure 4:
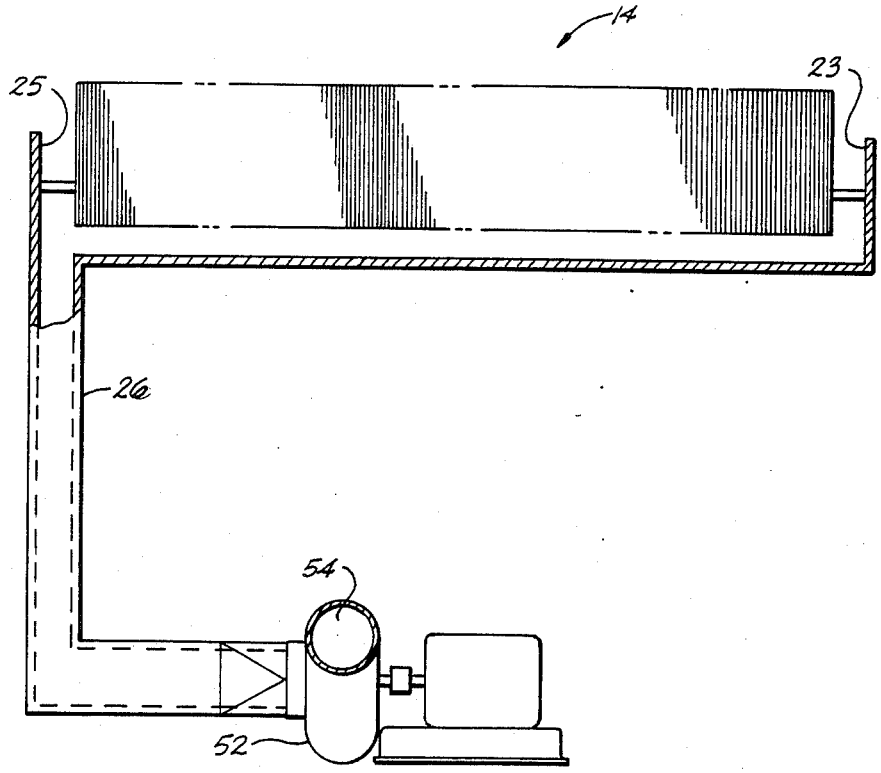
FIG. 4 is a rear cross-sectional enlarged view of the warp stop motion and its associated vacuum chamber showing one means for forming a partial vacuum within the vacuum chamber.

Referring now to FIG. 5 wherein an alternative embodiment of the invention is illustrated. In this embodiment, a vacuum chamber 60 comprising walls 62 and 64, ends (not shown) and a partial top, partially enclose the drop wires 15 of a warp stop motion 14. Disposed within vacuum chamber 60 and partially surrounding the lower ends of the drop wires are baffles 66 and 68 which causes the air drawn from the ambient atmosphere to be drawn both longitudinally of the drop wire axis, as well as transversely thereof, respectively, through openings 70 and 72.

Disposed beneath and partially surrounding the harnesses 12 is a vacuum chamber 74 which comprises walls 75 which have a clearance between the walls and the harnesses as noted with regard to FIG. 3. Disposed within vacuum chamber 74 are baffles 76 and 78 which terminate at their upper extremity into a transverse, longitudinal port or slot 80 adjacent to the surfaces of the harnesses, and at their lower extremity in exhaust ports 82. Thus, as a partial vacuum is created within central exhaust duct 28 by turbine or blower 52, air from the ambient atmosphere is drawn longitudinally of the heddles and through exhaust port 82. This air serves to condition the warp yarns at the point of their greatest stress and also to clean much of the lint, fly, dust, oil and the like from the harnesses. In addition, the creation of a partial vacuum within vacuum chamber 74 causes transverse air currents to be drawn through longitudinal ports 80, thereby providing additional cleaning of the harness surfaces.

It will also be understood that the means for creating a partial vacuum within the vacuum chambers may be provided for each individual weaving machine, that is each weaving machine may have its own vacuum pump and motor, or the vacuum creating mechanism may be provided at a central station within the weaving room with a suitable connection for each of the weaving machines. The use of a central collection point makes recovery of the waste material more efficient.

In any event, whether the vacuum source is provided for individually on the weaving machines or from a central location, means are contemplated for turning the vacuum producing means off whenever the weaving machines are stopped. Where individual units are provided for each weaving machine, the turbine may simply be turned off, or where a central collection system is utilized, damper means may be provided for closing the system of individual weaving machines off from the central vacuum source.

While there is shown and described a preferred embodiment of the invention using specific terms, it is to be understood that the invention is not limited thereto, but may be otherwise variously embodied in practice within the scope of the appended claims.

What is claimed is:

1. In a weaving machine having a warp supply, a warp stop motion having drop wires, a harness motion for selectively raising and lowering warp ends passing through the drop wires and harness heddles, a reed mounted on a sley for beating up weft yarn, and a cloth take-up roll, means for conditioning the warp yarns and for cleaning lint, size and fly from selected surfaces of said weaving machine, comprising:

(a) a first vacuum chamber disposed beneath and having walls which partially surround the warp stop motion, having an open top, through which the drop wires extend;

(b) a second vacuum chamber disposed adjacent to the harnesses in a position to receive air passing over the heddles and the warp yarn from the ambient atmosphere of the weave room; and (c) means for creating a partial low pressure vacuum within said vacuum chambers whereby the ambient atmosphere of the weave room is drawn into said vacuum chambers, across the warp yarn, the drop wires, the heddles, and adjacent surfaces of the weaving machine, to condition the warp yarns and to clean the drop wires, the heddles, and adjacent weaving machine surfaces to remove lint, size and fly developed when the warp yarn passes through said drop wires and said heddles.

2. In a weaving machine as set forth in claim 1, wherein means are provided to maintain said low pressure vacuum as long as the weaving machine is weaving.

3. In a weaving machine as set forth in claim 1, wherein said low pressure vacuum is created by a central source.

4. In a weaving machine as set forth in claim 1, wherein said low pressure vacuum means is driven by a separate motor on said weaving machine.

5. In a weaving machine as set forth in claim 1, wherein a third vacuum chamber is disposed for cleaning the reed prior to beat-up of the weft.

6. In a weaving machine as set forth in claim 5, wherein said third vacuum chamber is stationary and cleans the reed when the sley is near back center.

7. In a weaving machine as set forth in claim 1, wherein said first vacuum chamber is shaped to cause the air flow through the drop wires generally along the longitudinal axes of said drop wires.

8. In a weaving machine as set forth in claim 7, wherein said first vacuum chamber is shaped to cause a second air flow through said drop wires to pass transverse of the longitudinal axes of said drop wires.

9. In a weaving machine as set forth in claim 7, wherein said second vacuum chamber is shaped to cause the air flow through said heddles generally transverse of the longitudinal axes of said heddles.

10. In a weaving machine having a warp supply, a warp stop motion having drop wires, a harness motion for selectively raising and lowering warp ends passing through the drop wires in harness heddles, a reed mounted on a sley for beating up weft yarn, and a cloth take-up roll, means for conditioning the warp and weft yarns and for cleaning lint, size and fly from selected surfaces of said weaving machine, comprising:

(a) a first vacuum chamber disposed beneath the warp stop motion having walls which partially surround the warp stop motion and a top which has an opening through which the drop wires extend, said top terminating in a lip short of said drop wires;

(b) a first baffle extending longitudinally of said warp stop motion and supported within said first vacuum chamber, having one edge which terminates adjacent to and spaced from a first portion of said vacuum chamber top and another edge which terminates beneath said drop wires;

(c) a second baffle extending longitudinally of said drop wires and supported within said first vacuum chamber, having an edge which terminates adjacent to, but spaced from a second edge of said first vacuum chamber top, and a second edge which terminates adjacent to, but spaced from said second edge of said first baffle beneath the heddles of said stop motion;

(d) a second vacuum chamber disposed adjacent to the harnesses in a position to receive air passing over the heddles and the warp yarns from the ambient atmosphere of the weave room; and (e) means for creating a partial low pressure vacuum within said vacuum chambers whereby the ambient atmosphere of the weave room is drawn into said first vacuum chamber through the space between the first baffle and the first top portion of said first vacuum chamber, between the second baffle and the second top portion of said first vacuum chamber, and between the space between said first and second baffles, so as to draw air from the ambient atmosphere across the warp yarn along the longitudinal axis of said drop wires as well as transverse of said longitudinal axis of said drop wires to condition the warp yarns and to clean the drop wires.

11. In a weaving machine as set forth in claim 10, wherein said low pressure vacuum continues as long as the weaving machine is weaving.

12. In a weaving machine as set forth in claim 10, wherein said low pressure vacuum is created by a central source.

13. In a weaving machine as set forth in claim 10, wherein said low pressure vacuum means is driven by a separate motor on said weaving machine.

14. In a weaving machine as set forth in claim 10, wherein a third vacuum chamber is disposed for cleaning the reed prior to beat-up of the weft.

15. In a weaving machine as set forth in claim 14, wherein said third vacuum chamber is stationary and cleans the reed when the sley is near the back center position.

16. In a weaving machine having a warp supply, a warp stop motion having drop wires, a harness motion for selectively raising and lowering warp ends passing through the drop wires in harness heddles, a reed mounted on a sley for beating-up weft yarn, and a cloth take-up roll, means for conditioning the warp and the weft yarns and for cleaning lint, size and fly from selected surfaces of said weaving machine, comprising:

(a) a first vacuum chamber having walls which partially surround the warp stop motion and an open top through which the drop wires extend, disposed beneath said warp stop motion;

(b) a second vacuum chamber having walls and a top which partially surround the harnesses, the top having an opening through which said harnesses extend, a first baffle located within said second vacuum chamber and extending along a longitudinal wall of said chamber having an edge which terminates adjacent to a first edge of the top of said vacuum chamber, and a second edge which terminates beneath the harnesses adjacent to the bottom of the second vacuum chamber;

(c) a second baffle supported within said second vacuum chamber and extending along a second longitudinal wall of said second vacuum chamber and terminating adjacent a second edge of the top of said second vacuum chamber, said baffle having a second edge which terminates beneath the harnesses adjacent to but spaced from the second edge of said first baffle; and (d) means for creating a partial low pressure vacuum within said vacuum chambers whereby the ambient atmosphere of the weave room is drawn into said vacuum chambers through the spaces between said baffles and the first and second edges of said top and through said space between the second edges of said baffles adjacent to the bottom of said second vacuum chamber, whereby air from the ambient atmosphere is drawn both longitudinally of the heddles and transversely of the heddles into the second vacuum chamber.

* * * * *